US010166486B2

(12) United States Patent
Erhart et al.

(10) Patent No.: US 10,166,486 B2
(45) Date of Patent: Jan. 1, 2019

(54) SELF-RIGHTING MODEL VEHICLE

(71) Applicant: TRAXXAS LP, McKinney, TX (US)

(72) Inventors: Wesley Ronald Erhart, McKinney, TX (US); Thomas Michael Kawamura, Plano, TX (US)

(73) Assignee: TRAXXAS LP, McKinney, TX (US)

( * ) Notice: Subject to any disclaimer, the term of this patent is extended or adjusted under 35 U.S.C. 154(b) by 0 days.

(21) Appl. No.: 15/708,820

(22) Filed: Sep. 19, 2017

(65) Prior Publication Data

US 2018/0071646 A1 Mar. 15, 2018

Related U.S. Application Data

(62) Division of application No. 14/935,000, filed on Nov. 6, 2015, now Pat. No. 9,789,413.

(60) Provisional application No. 62/076,870, filed on Nov. 7, 2014, provisional application No. 62/247,173, filed on Oct. 27, 2015.

(51) Int. Cl.

| | |
|---|---|
| ***A63H 17/00*** | (2006.01) |
| ***A63H 30/04*** | (2006.01) |
| ***A63H 15/06*** | (2006.01) |
| ***A63H 17/395*** | (2006.01) |
| ***A63H 17/26*** | (2006.01) |
| ***A63H 29/20*** | (2006.01) |

(52) U.S. Cl.

CPC ..... *A63H 17/004* (2013.01); *A63H 15/06* (2013.01); *A63H 17/262* (2013.01); *A63H 17/395* (2013.01); *A63H 29/20* (2013.01); *A63H 30/04* (2013.01)

(58) Field of Classification Search

CPC .... A63H 15/06; A63H 17/004; A63H 17/395; A63H 30/04

USPC ..... 446/431, 437, 454, 456, 465, 470

See application file for complete search history.

(56) References Cited

U.S. PATENT DOCUMENTS

| | | | | |
|---|---|---|---|---|
| 3,000,137 A * | 9/1961 | Vine | ..... | A63H 17/02 446/309 |
| 3,650,067 A * | 3/1972 | Greenwood | ..... | A63H 29/20 446/233 |
| 4,300,308 A * | 11/1981 | Ikeda | ..... | A63H 17/40 446/457 |

(Continued)

FOREIGN PATENT DOCUMENTS

JP 2002-224462 8/2002

OTHER PUBLICATIONS

International Search Report and Written Opinion; re PCT/US2015/059542, dated Mar. 17, 2016.

*Primary Examiner* — Alexander Niconovich

(74) *Attorney, Agent, or Firm* — Daryl R. Wright; Greg Carr

(57) ABSTRACT

A process for self-righting an inverted remote controlled model vehicle is provided. The process includes the method of determining a current pitch angle and a current angular rocking rate of the model vehicle and accelerating or decelerating a mass on the model vehicle based on the current pitch angle and the current angular rocking rate of the model vehicle to create a rocking motion by the model vehicle. In addition, the method also includes terminating the self-righting process when the model vehicle is upright. In which, the model vehicle body contacts the ground and provides a fulcrum for the rocking motion by the model vehicle.

20 Claims, 15 Drawing Sheets

(56) References Cited

U.S. PATENT DOCUMENTS 4,363,187 A * 12/1982 Shinohara ..... A63H 17/004 446/437
4,591,346 A * 5/1986 Ikeda ..... A63H 17/004 446/437
4,705,487 A * 11/1987 Ishimoto ..... A63H 17/004 446/290
4,767,376 A * 8/1988 Hanzawa ..... A63H 17/004 446/396
4,894,042 A * 1/1990 Kamikawa ..... A63H 17/004 446/437
5,727,986 A * 3/1998 Stubenfoll ..... A63H 17/004 446/437
5,803,790 A * 9/1998 Tilbor ..... A63H 17/004 446/436
5,947,788 A * 9/1999 Derrah ..... A63H 13/04 114/144 A
6,129,607 A * 10/2000 Hoeting ..... A63H 17/004 446/396
6,227,934 B1 * 5/2001 Isaksson ..... A63H 17/004 446/437
6,241,574 B1 * 6/2001 Helbing ..... A63H 30/04 446/454
7,467,684 B2 * 12/2008 Wang ..... B60R 21/0132 180/282
8,038,504 B1 * 10/2011 Wong ..... A63H 30/04 446/431
8,342,904 B2 1/2013 Torres
8,528,854 B2 * 9/2013 Yan ..... A63H 27/12 244/119
8,900,031 B2 * 12/2014 Benedict ..... A63H 17/004 446/437
8,939,812 B2 * 1/2015 Chan ..... A63H 17/395 446/454
8,974,265 B2 3/2015 Wallace
9,067,667 B2 * 6/2015 Yan ..... B64C 1/00
9,283,489 B2 * 3/2016 Pischiera ..... A63H 17/262
9,352,242 B2 * 5/2016 Rehkemper ..... A63H 30/04
2003/0077979 A1 * 4/2003 Hoeting ..... A63H 17/004 446/431
2008/0261487 A1 * 10/2008 Torres ..... A63H 17/004 446/448
2009/0149113 A1 * 6/2009 Lund ..... A63H 17/004 446/454
2011/0240382 A1 * 10/2011 Gettings ..... B62D 55/075 180/9.1
2012/0298430 A1 * 11/2012 Schroll ..... B62D 37/06 180/8.1
2013/0252510 A1 * 9/2013 Wallace ..... A63H 17/004 446/465
2014/0057525 A1 * 2/2014 Olivera ..... A63H 11/20 446/356

* cited by examiner

SELF-RIGHTING MODEL VEHICLE

This application is a divisional of co-pending non-provisional U.S. patent application Ser. No. 14/935,000, entitled SELF-RIGHTING MODEL VEHICLE, filed Nov. 6, 2015, which relates to, and claims the benefit of the filing date of, U.S. Provisional Patent Application Ser. No. 62/076,870, entitled SELF-RIGHTING MODEL VEHICLE, filed on Nov. 7, 2014, and U.S. Provisional Patent Application Ser. No. 62/247,173, entitled SELF-RIGHTING MODEL VEHICLE, filed on Oct. 27, 2015, the entire contents including any appendices which are incorporated herein by reference for all purposes.

BACKGROUND OF THE INVENTION

Field of the Invention

The present invention relates to model vehicles and, more particularly, to motorized, radio-controlled model vehicles.

Description of the Related Art

When the driver of a radio-controlled (RC) model vehicle, such as a motorized car or truck, turns the model vehicle too sharply at an excessive speed, the model vehicle may flip over. Typically, more times than not, the flip may end with the model vehicle upside down, or inverted. By the nature of radio control, the driver has to walk to the model vehicle, flip it upright, and walk back to his or her initial location. This is known within the sport as "the walk of shame."

A skilled driver can sometimes use steering and the motor torque to right the vehicle. The farther the skilled driver is from the vehicle the harder it is for the skilled driver to perform this feat. Therefore, even skilled drivers may take "the walk of shame."

SUMMARY

The present invention provides a self-righting model vehicle.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

The entire contents of: Provisional Patent Application Ser. No. 62/076,870, entitled SELF-RIGHTING MODEL VEHICLE, filed on Nov. 7, 2014; Provisional Patent Application Ser. No. 62/222,094, entitled MOTOR-OPERATED MODEL VEHICLE, filed on Sep. 22, 2015; Provisional Patent Application Ser. No. 62/149,514, entitled STEERING STABILIZING APPARATUS FOR A MODEL VEHICLE, filed on Apr. 17, 2015; Provisional Patent Application Ser. No. 62/149,515, entitled THROTTLE TRIGGER STATE MACHINE FOR A MODEL VEHICLE, filed on Apr. 17, 2015; Provisional Patent Application Ser. No. 62/149,517, entitled STEERING STABILIZING SYSTEM WITH AUTOMATIC PARAMETER DOWNLOAD FOR A MODEL VEHICLE, filed on Apr. 17, 2015; Provisional Patent Application Ser. No. 62/247,173, entitled SELF-RIGHTING MODEL VEHICLE, filed on Oct. 27, 2015 and including any appendices, are incorporated herein by reference for all purposes.

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, specific details, and the like have been omitted inasmuch as such details are not considered necessary to obtain a complete understanding of the present invention.

A model vehicle 100 may perform an automatic, self-righting maneuver using a righting mechanism comprising parts of the model vehicle 100 including the wheels, body, electronics, and motor dynamics of the model vehicle 100 to rock the inverted model vehicle 100. The inverted model vehicle 100 may add energy with each cycle of rocking until the rocking of model vehicle 100 may eventually build up enough energy to tumble the model vehicle 100 upright.

Figure 1:
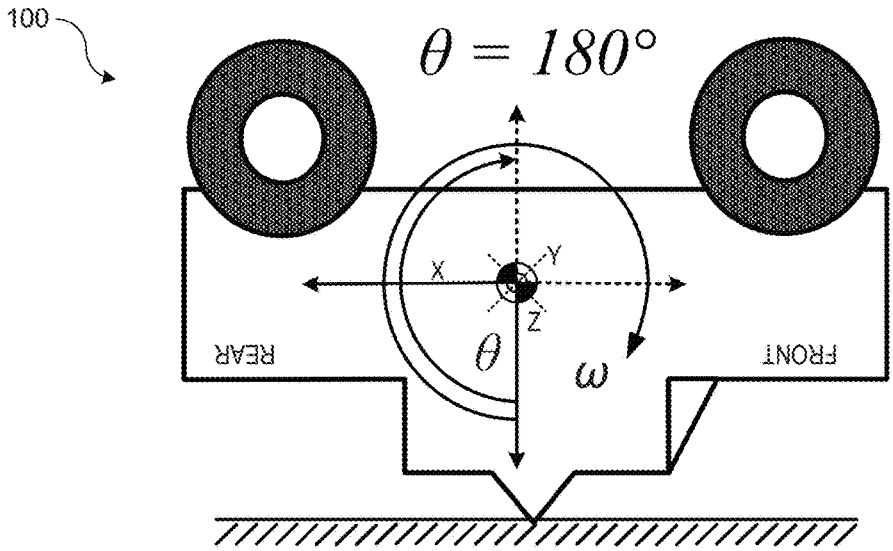
FIG. 1 illustrates schematically a pitch angle for an inverted model vehicle.
Figure 2:
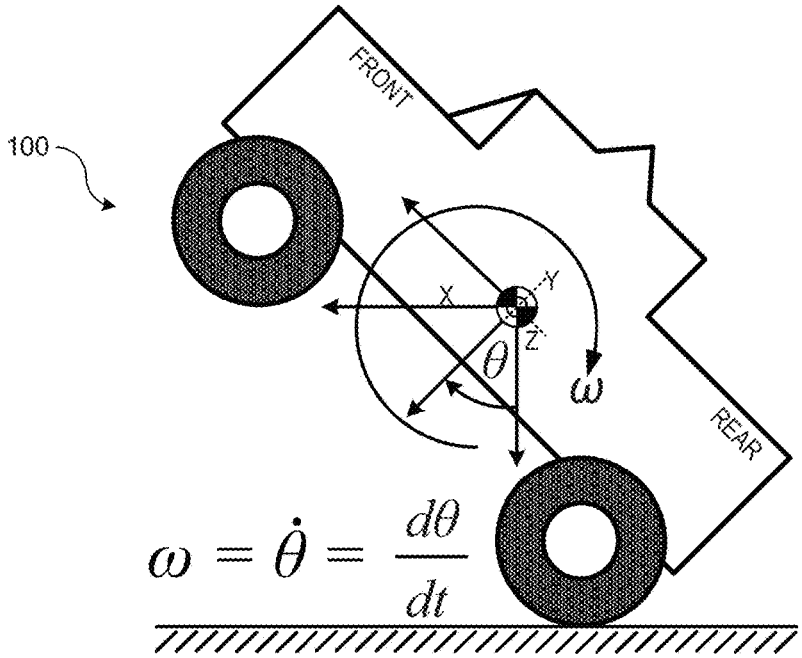
FIG. 2 illustrates schematically change in the pitch angle over time.

Turning to FIG. 1, in an embodiment, the model vehicle 100 may be shown with a defined pitch angle $\theta$ with units of degrees (or radians). When the vehicle is upright, the pitch angle $\theta$ may be zero degrees. When the model vehicle 100 is inverted, the pitch angle $\theta$ may be 180 degrees, as shown in FIG. 1. When the model vehicle 100 is inverted, the model vehicle 100 may rock, changing the pitch angle $\theta$ of the model vehicle 100. In FIG. 2, the pitch angle $\theta$ may change over time with an angular rate of change $\omega$, in units degrees/sec., or in units radians/sec.

When the model vehicle 100 is inverted, the model vehicle 100 may perform a self-righting maneuver by rocking the model vehicle 100 itself over. When the inverted model vehicle 100 is rocking, the pitch angle θ may move above and below 180 degrees. The rocking of the inverted model vehicle 100 may be analogous to a swing or a see-saw. The control input or push to initiate the rocking of the inverted model vehicle 100 may be the application of a torque or the reaction torque to the wheels of the model vehicle 100. In the embodiment shown, one push direction (clockwise in FIG. 6A) may be actuated by using a forward throttle and rotating the mass of the wheels in a forward direction. A second or opposite push direction (counter-clockwise in FIG. 6B) may be actuated by the application of the brakes to the forward spinning wheels. Alternatively, the application of the brakes may comprise the application of a mechanical brake to slow the model vehicle 100 during normal driving and/or reverse throttling/acceleration of the model vehicle 100. The reverse throttling/acceleration may be applied until the wheels of the model vehicle 100 stop rotating, or in certain instances, may be applied to rotate the mass of the wheels in a direction opposite of the forward direction. Throttling the wheels however in either the forward or reverse direction may generate less rocking torque than braking an already spinning wheel. Throttling the wheels may require more time to put energy into the spinning wheels, and as such, the "impact" torque imparted to the model vehicle 100 during throttling may be less than during braking. Decelerating spinning wheels from a given speed, to zero, may require less time than to accelerate the same wheels from zero up to the same given speed. Therefore, the "impact" to the model vehicle 100 may be greater when decelerating the wheels than it is during throttling.

Figure 3:
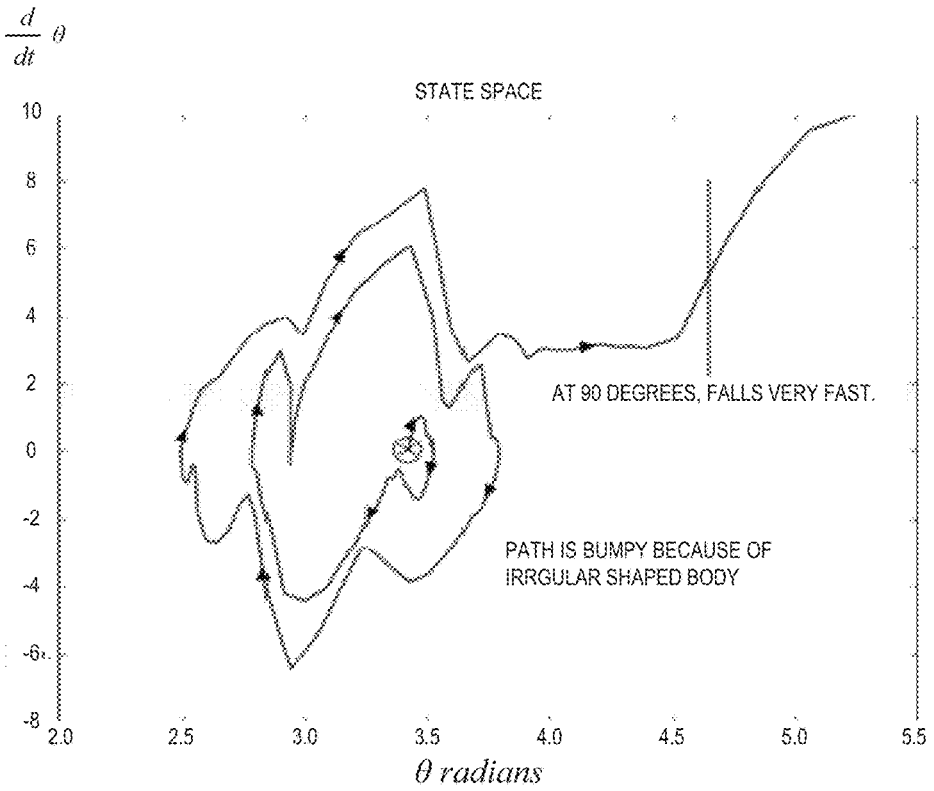
FIG. 3 illustrates graphically a state space trajectory of manually righted model vehicle.

Turning to FIG. 3, a two-dimensional state space may be defined for the model vehicle 100. On the graph shown, the pitch angle θ may be represented on the x-axis, and the rate ω may be represented on the y-axis. The system may be plotted with manual input into a radio-control transmit controller from a skilled driver. The driver may apply the forward throttle and the brakes to rock the model vehicle 100 through approximately 270 degrees. When the pitch angle θ of the model vehicle 100 is brought within the range of approximately 90 degrees or 270 degrees, the model vehicle 100 may flip and topple upright. The outward spiral shown on FIG. 3 may occur as the system gains energy from the driver's timed torque input.

Figure 4:
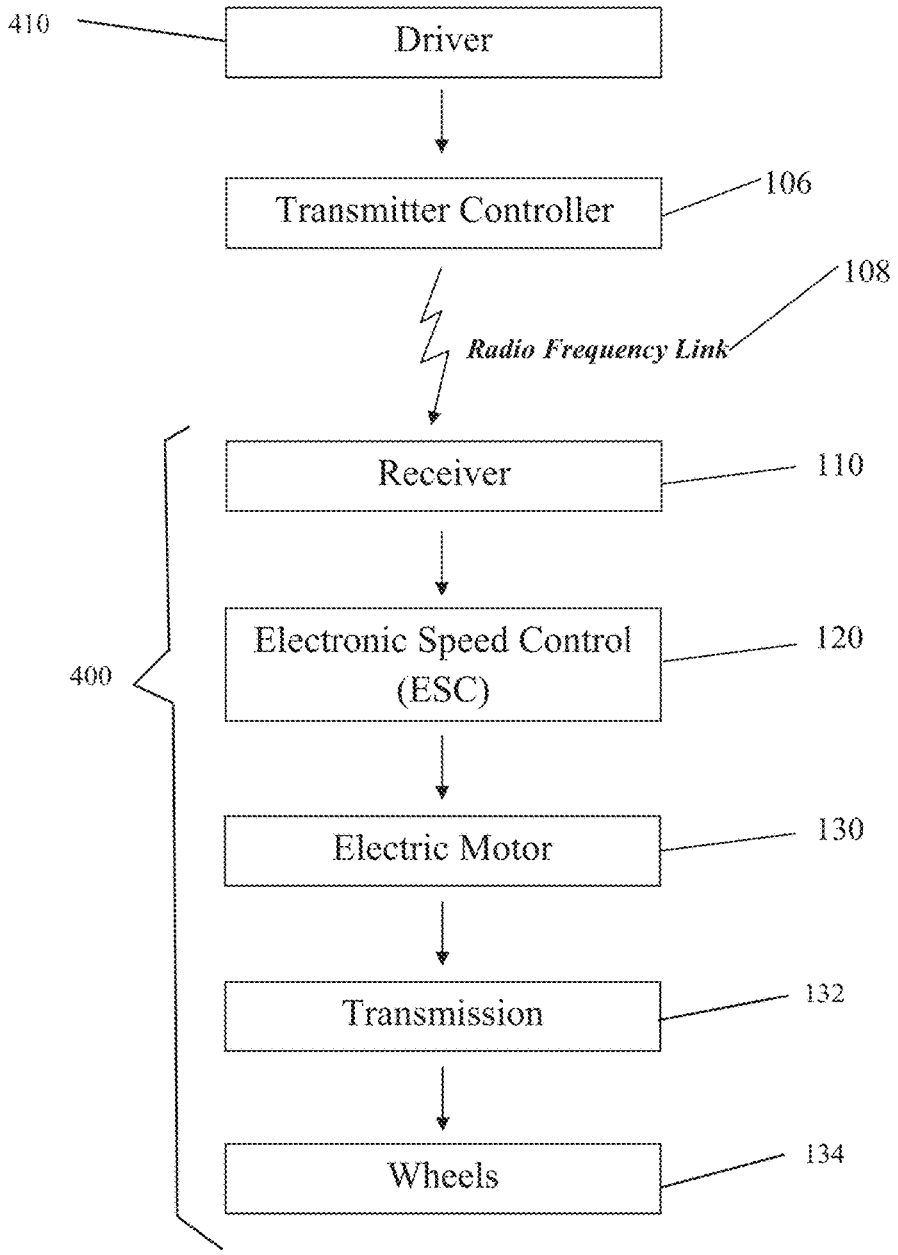
FIG. 4 is a block diagram illustrating a subsystem of connections between a driver and operation of the model vehicle.
Figure 6A:
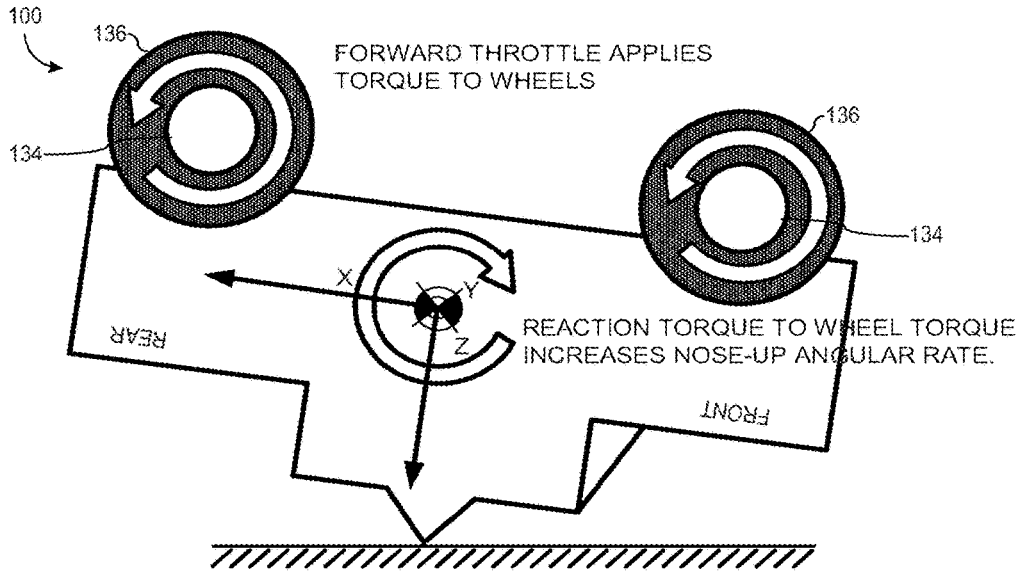
FIGS. 6A and 6B illustrate a forward and backward rocking of the model vehicle actuated by a reaction torque from throttle being applied to the model vehicle.
Figure 6B:
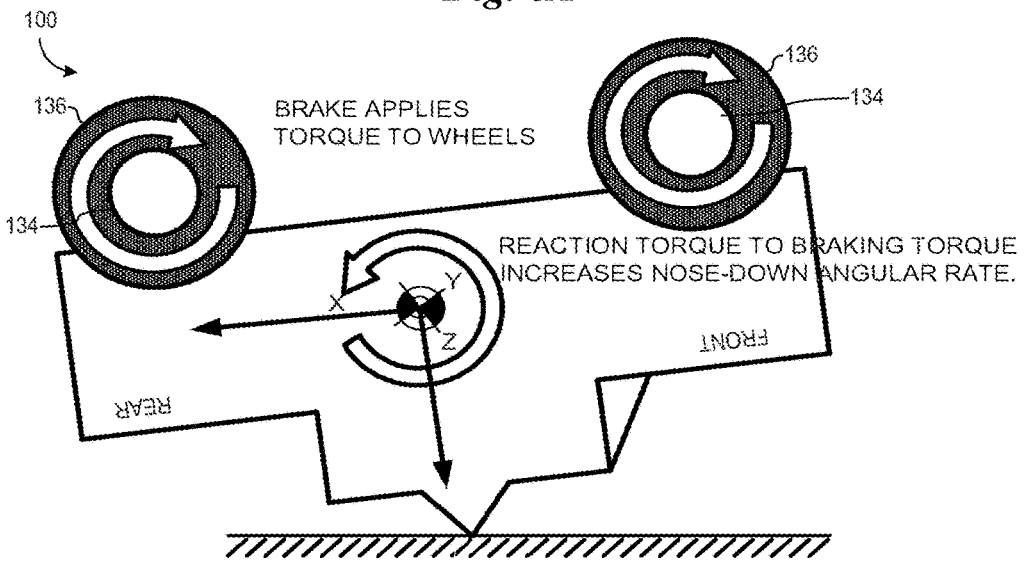

In FIG. 4, the model vehicle 100 may comprise a subsystem of connections wherein the driver 410 may actuate the self-righting process for the model vehicle 100. In an embodiment, the model vehicle 100 may comprise a subsystem 400 of connections comprising a Receiver 110, which may be coupled to an Electronic Speed Control (ESC) 120, which may be coupled to an Electric Motor 130, which may be coupled to a transmission 132, which may be coupled to the wheels 134. The wheels 134 may include tires 136, as shown in FIG. 6A-6B. The driver 410 may operate a Transmitter Controller 106, which may be in contact with the Receiver 110 via a Radio Frequency Link 108. The Transmitter Controller 106 may support a separate control channel, or other means, for initiating a self-righting routine that operates automatically without further operator input. This separate control channel may, in an embodiment, be controlled by a push-button switch on the Transmitter Controller.

Figure 5:
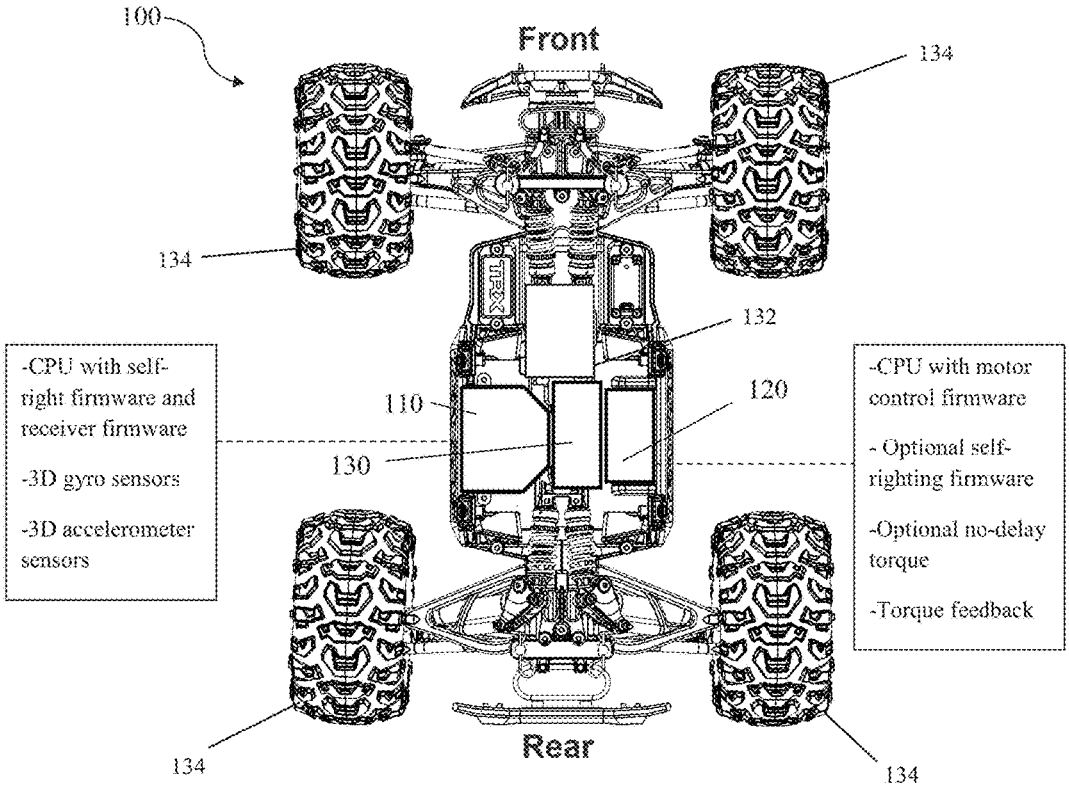
FIG. 5 is a top view of a model vehicle illustrating a subsystem of components on the model vehicle.

Referring to FIG. 5, the model vehicle 100 may be equipped with electronic sensors, firmware, and the like for determining the state (angle θ and rate ω) of the model vehicle 100 and controlling a motor torque of the model vehicle 100. In an embodiment, the model vehicle 100 may comprise a Receiver 110, an Electronic Speed Control 120, and an Electric Motor 130. The Receiver 110 may comprise a processor or central processing unit (CPU) with a Self-Righting firmware and a Receiver firmware, three-dimensional gyro sensors (3D Gyro Sensors), and three-dimensional accelerometer sensors (3D Accelerometer Sensors). The Electronic Speed Control 120 may comprise a processor or CPU with a Motor Control firmware, an optional Self-Righting firmware, an optional No-Delay Torque configuration, and a Torque Feedback.

The model vehicle 100 may comprise electronic sensors including Microelectromechanical systems (MEMS) that reside in a circuit board of the Receiver 110. The electronic sensors may comprise three rate gyros sensors that sense angular rate about the x, y, and z axis, and three accelerometers that measure force along the x, y, and z axes.

The CPU of the Receiver 110 may execute the Self-Righting firmware to determine the state of the model vehicle 100. The Self-Righting firmware may use the sensors' reported rates and forces to estimate the vehicle's pitch angle θ and rate ω. This estimation may be performed with a Kalman filter or a simple complementary filter. The firmware may implement a control law to bring the model vehicle 100 state into the desired range (angle around 90 degrees or around 270) while using the motor and wheel torque as the control input.

The attitude of the model vehicle 100 may be controlled about the long axis (140 in FIG. 7) to stabilize the model vehicle 100 and position it in a more optimal attitude for righting. The attitude of the model vehicle 100 may be controlled by steering the rotating wheels 134 of the model vehicle 100. The steering of the rotating wheels 134 may assist self-righting by moving and re-positioning the model vehicle 100 in a more favorable attitude with increased ability to self-right.

The steering stability firmware of the model vehicle 100 may be used to maintain stable and straight rocking of the model vehicle 100 when inverted. In an embodiment where the model vehicle 100 is a four-wheeled model vehicle, the attitude of the model vehicle may be controlled by the steering and accelerating of the wheels 134. The steering stability control may be used to maintain straight rocking of the inverted model vehicle 100 by steering the wheels 134 to counter any yawing of the inverted model vehicle 100. This may be accomplished by inverting the z-axis gyro measurement (since the model vehicle is inverted) and running steering stability algorithms. The gain of the controller in this case may be increased as the "steering authority" or the amount of inverted yaw caused by turning the wheels 134 may be small.

Figure 16:
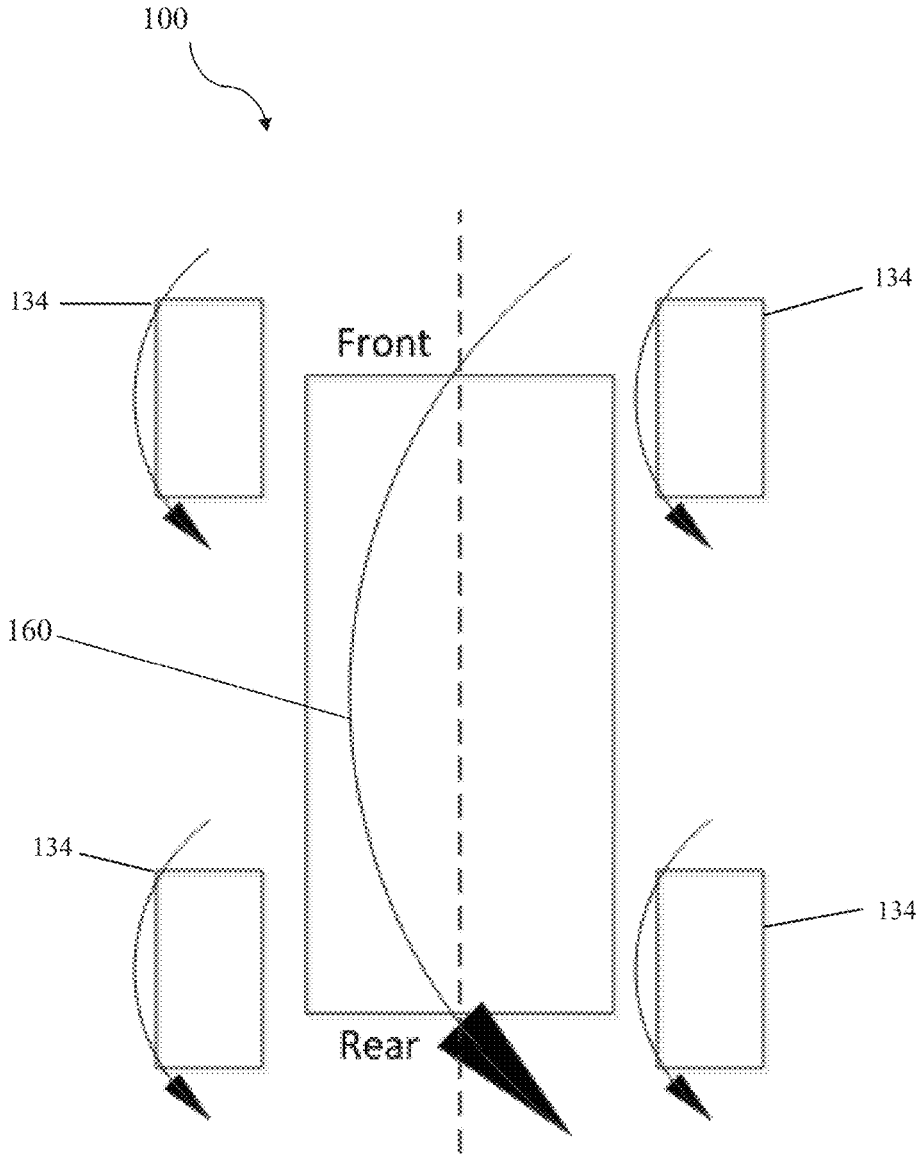
FIGS. 16 and 17 show a top view of a schematic drawing of the inverted model vehicle illustrating a yaw that may be imparted on the model vehicle when the spinning wheels on the model vehicle are straight, and steered, respectively.
Figure 17:
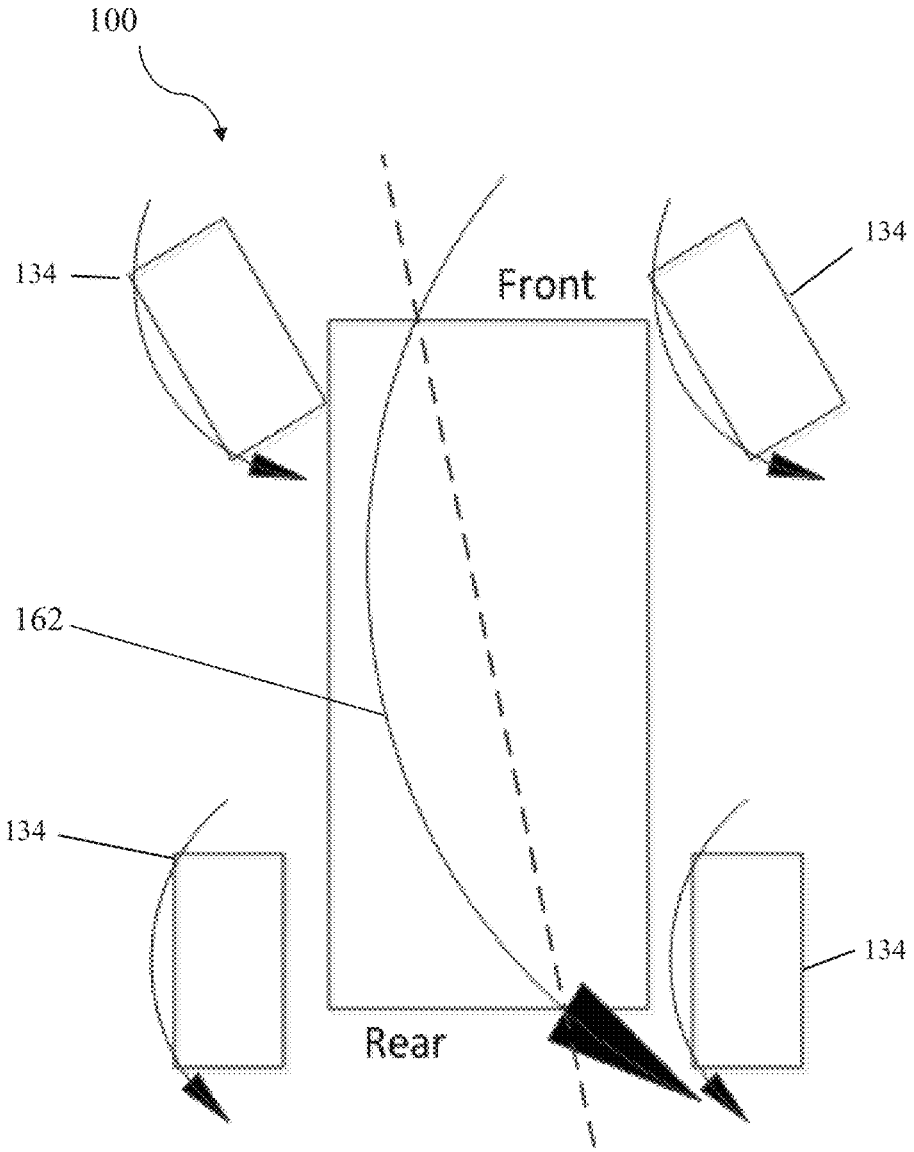

Turning to FIG. 16, the accelerating and braking of the wheels 134 without steering actuates the normal back and forward rocking of the inverted model vehicle 100. As shown in FIG. 17, the braking and accelerating of the wheels 134 of the model vehicle 100 while steering at an angle may be used to impart a yaw moment, a roll moment, or both to the model vehicle 100. The yaw and/or roll moments may be used to either position or stabilize the model vehicle 100 in a more optimal attitude for righting.

Figure 7:
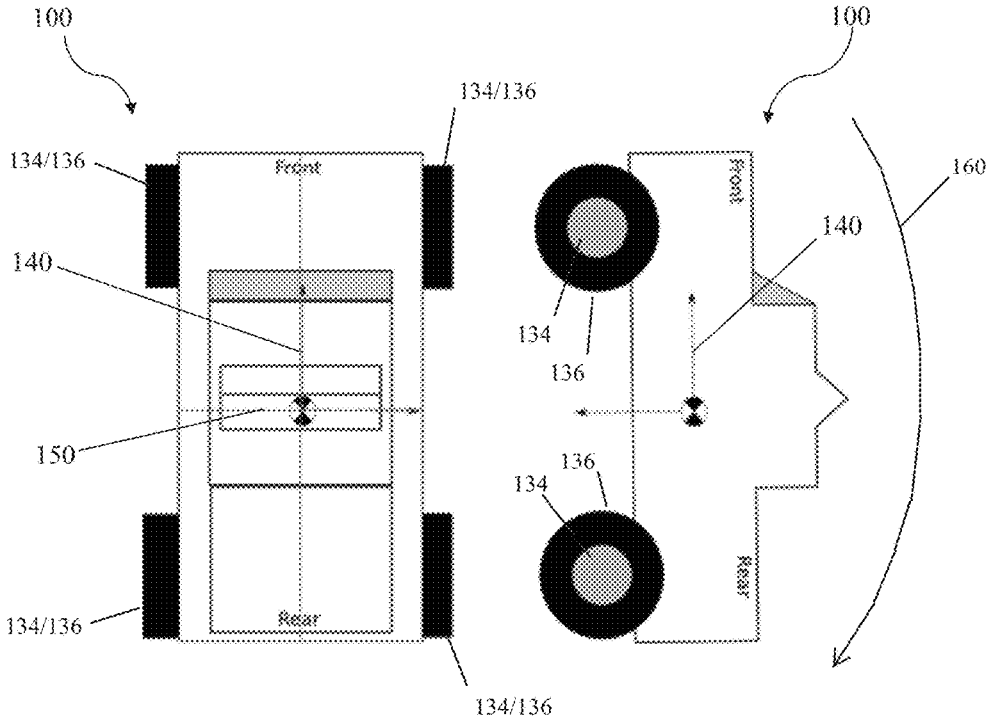
FIG. 7 illustrates a top and side view of the model vehicle with a long axis and a short axis.

In an embodiment, the steering of the accelerated wheels 134 may be used to counter unexpected yawing and maintain stable and straight rocking of the inverted model vehicle 100. The direction of the rocking of the model vehicle 100 may generally follow the direction the wheels 134 are spinning. After a forward rock actuated by the torque from the forward spinning of the wheels 134, the wheels 134 may brake or reverse throttle to generate energy for the upcoming backwards rock. As shown in FIG. 16, the forward throttling of the wheels 134 when aligned straight without steering may impart a force 160 on the inverted model vehicle 100 about the short axis 150 (as shown in FIG. 7. The force 160 may contribute to the straight forward and backward rocking of the model vehicle 100. However, in the instance that the rocking of the model vehicle 100 begins to yaw and deviate from the straight forwards and backwards rocking, the model vehicle 100 may anticipate the upcoming yaw and compensate by adjusting the spinning wheels 134 so as to apply the upcoming generated torque in a direction that counters the yaw to realign the upcoming rock straight. In an example as shown in FIG. 17, the wheels 134 of the model vehicle 100 may be steered so as to allow the forward spinning wheels 134 to accelerate and apply a force 162 that may be directed at an angle, depending on the direction of the steering of the wheels 134. The angled force generated from the accelerating wheels 134 may be directed to counter the upcoming yaw. The generated force from the torque of the forward spinning wheel may be used to realign the model vehicle to rock straight.

As an example for correcting inadvertent yaw, in an embodiment, just prior to a forward rock, there may be an anticipated and upcoming yaw by the model vehicle 110 which would shift the upcoming forward rock by some amount to one side or the other of a forward rocking axis. To counter the anticipated yaw by the model vehicle 100, the spinning wheels 134 of the model vehicle 100 may be steered prior to the forward throttling and forward rock by some amount towards the opposite side from the anticipated yaw with respect to the forward rocking axis. This may compensate for the anticipated yaw. The steering of the wheels 134 prior to the throttling may then direct the torque generated from the now forward accelerating wheels 134 to one side to counter the anticipated yaw towards the other side. The countering of the leftward yaw by rightly angled torque may redirect the model vehicle 100 to rock straight along the forward rocking axis. Conversely, the countering of the rightward yaw by leftly angled torque may redirect the model vehicle 100 to rock straight along the forward rocking axis.

The components required for the self-righting system reuses many of the components of the vehicle stability system, including sensors, the CPU of the Receiver 110, and the stability system's firmware. The state estimation and throttle control firmware may be reused from the model vehicle 100's stability control firmware. The stability control firmware may use a steering stability algorithm in connection with the sensors of vehicle stability system to anticipate upcoming yaws when the inverted model vehicle 100 is rocking. The steering stability control may then steer the wheels 134 as described to compensate for the anticipate yaw and redirect the upcoming rock. The stability control firmware in connection with the motor control firmware may both be used so as to steer the wheels 134 while accelerating to generate an angled torque that may counter any inadvertent yaw.

In an example for achieving steering stability where a heading hold gyro may be used, additional adjustments may be required. This may require the addition of an integral component to measure the yaw rate. Errors may add up when the steering stability system cannot quickly cancel the accumulated error. A person of ordinary skill in the art would understand that additional adjustments for inverted yaw control may comprise higher gain, lower wind-up values, PD only controller, or more advanced state controllers.

The stability system using the steering and acceleration of the wheels 134 may also provide a mechanism to lift the model vehicle 100 from a position where the model vehicle 100 may be leaning on a corner or a side at an angle. The wheels 134 may be steered and accelerated to generate a torque that rocks the model vehicle 100 in a direction opposite of the angled lean to lift and realign the inverted model vehicle to a more favorable attitude for rocking and self-righting. Alternatively, when the model vehicle 100 is inverted and leaning at an angle towards the corner or side of the model vehicle 100, turning the wheels 134 may roll the model vehicle 100 or parts of the model vehicle 100 to position the vehicle in a more optimal attitude for righting.

A least time control strategy may be implemented to apply the maximum available torque at the peak of each rocking motion to put energy into the system so that the model vehicle 100 may eventually tumble upright. The peak of each of the rocks may occur when the rate $\omega$ is 0. Intuitively, a small exploration of the swing analogy makes the invention very easy to comprehend. If a pusher pushes a swinger before the swing has reached its peak, the swinger loses energy because the pusher pushes against the swinger's momentum. However, if the pusher pushes after the top of the swing, the pusher adds energy by accelerating the swinger. The swinger stores energy alternating between kinetic energy (at the bottom of the swing) and potential energy at the top. Typically, a pusher can't push the swinger in a single push to the desired height. However, by timing smaller pushes, the pusher can put sufficient energy into the swinger to achieve any possible swing height. Likewise, while the motor and the wheel momentum typically may not be sufficient to immediately right an inverted vehicle, the timed pushing of the motor and wheel momentum can build a rocking motion that may eventually right the model vehicle 100. In an embodiment, it may be optimal that each of the high torque input from any one of the forward spinning, braking, or reverse throttling of the wheels 134 occur when the pivot point contacting the ground is under the center of gravity (C.G.) of the inverted model vehicle. Otherwise, the model vehicle 100 may lift off the ground which may reduce the ability of the model vehicle 100 to self-right.

Referring now to FIGS. 6A and 6B, in an embodiment, a combination of the forward throttle and the brakes may be used to apply torque to the wheels 134 and tires 136 to rock an inverted model vehicle 100. As shown on the model vehicle 100 in FIG. 6A, the forward throttle may be used to apply torque to the wheels 134 and tires 136 in a forward direction and thereby causing the model vehicle 100 to rock in a first direction. At the peak of the rock in the first direction wherein the rate $\omega$ may be 0, as shown in FIG. 6B, the brakes or the reverse throttle may then be used to apply a torque to the wheels 134 and tires 136 in a rearward direction. The brakes or reverse throttle being applied may cause the model vehicle 100 to react and rock in a second direction opposite from the first direction.

Turning to FIG. 7, the model vehicle 100 may comprise a short axis 150 that extends from one side of the model vehicle 100 to the other side, and a long axis 140 that extends from one end of the model vehicle 100 to the other end. The rocking caused by the forward throttle and the brakes applying torque to the wheels 134 and tires 136 may cause the model vehicle 100 to rock about the short axis. A method of timed pushing with motor and wheel momentum may build a rocking motion that may eventually right the inverted model vehicle 100.

Figure 8:
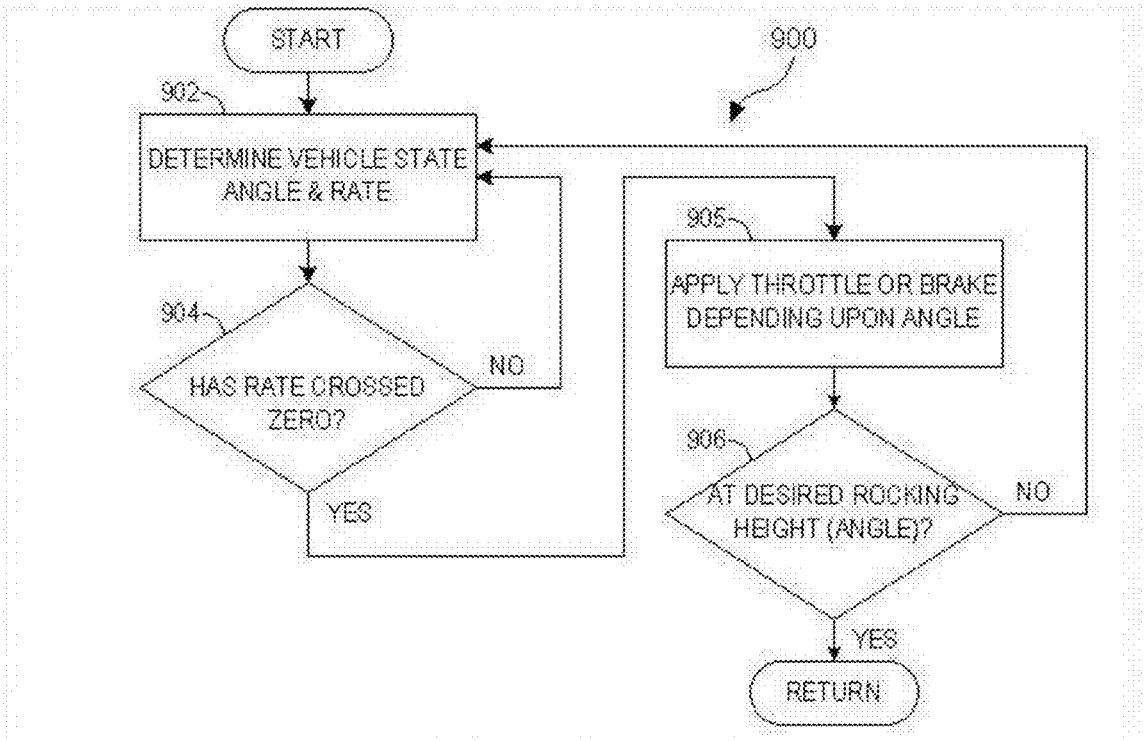
FIG. 8 is a flow chart illustrating an operation for self-righting the model vehicle by a motor control firmware.

The forward throttling and the braking of the model vehicle 100 to rock an inverted model vehicle 100 may be actuated by the Motor Control firmware in the CPU of the ESC 120. As illustrated in FIG. 8, the Motor Control firmware may follow an algorithm comprising a self-righting operation 900. The algorithm may proceed as follows:

Starting with Step 902, the system may determine the model vehicle 100 state (angle θ and rate ω).

In Step 904, the system may determine whether the rate ω has crossed zero. If the rate ω has not crossed zero, the system returns to Step 902. If the rate ω has crossed zero, the system proceeds to Step 905.

In Step 905, the system may apply forward throttle, accelerating the mass of the wheels in a forward direction, or brake, applying reverse acceleration, depending on angle θ. In certain instances, reverse acceleration may go as far as rotating and accelerating the mass of the wheels in a reverse direction. In other instances, "braking" may comprise applying reverse acceleration until the rotation of the wheels stops, and may be sufficient to self-right the vehicle.

In Step 906, the system may determine whether the model vehicle 100 is at desired rocking height, as indicated by angle θ. If the model vehicle 100 is not at the desired height, the system may return to Step 902. If the model vehicle 100 is at the desired height, the system may exit the self-righting operation 900 and return to its normal operation.

In an alternative embodiment, the system at Step 905 may apply reverse throttle, accelerating the mass of the wheels in a reverse direction, or the brake, depending on angle θ. In such an embodiment, "braking" may comprise applying forward acceleration to the wheels rotating in reverse. In such an embodiment, the forward acceleration may go as far as rotating and accelerating the mass of the wheels in a forward direction. In other instances, "braking" may comprise applying forward acceleration until the rotation of the wheels stops, and may be sufficient to self-right the model vehicle 100.

In another alternative embodiment, the system at Step 905 may apply the forward throttle or the reverse throttle, depending on the angle θ. This technique may be used, for example, when braking the wheels to stop their rotation provides insufficient force to self-right the vehicle. Cycling between forward and reverse rotation may provide potentially twice the torque and/or angular momentum as acceleration in one direction and braking to stop the wheel rotation.

There may be several factors that affect the ability of a model vehicle 100 to perform this type of rocking. A higher wheel rotational inertia may be better for rocking initiation. For example, a 4-wheel drive model vehicle 100 may have higher total driven wheel inertia than a 2 wheel drive vehicles. Furthermore, the lower the center of gravity (C.G.) when the model vehicle 100 is upright, the higher the C.G. when inverted. A model vehicle 100 with a higher inverted C.G. may be easier to rock and thus easier to right.

Figure 9:
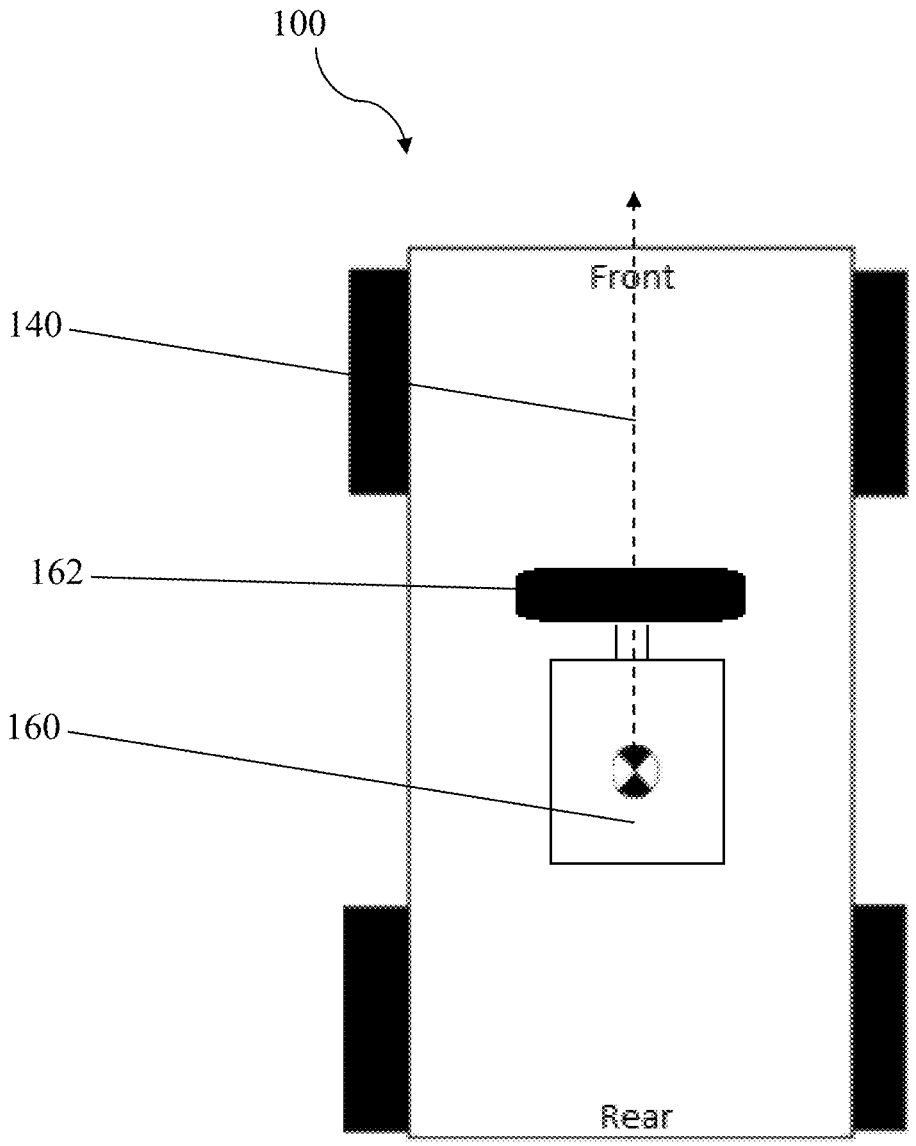
FIG. 9 illustrates an embodiment of the model vehicle with an auxiliary wheel for righting the model vehicle about the long axis of the model vehicle.

Alternatively, while it is desirable to use the existing wheels and motors to initiate and grow the rocking, in an embodiment, it may be possible to rock a vehicle upright using an auxiliary wheel. The auxiliary wheel may be mounted along the long axis of the vehicle. Self-righting rotation may then be initiated around the Long axis 140. Rotating about the Long axis 140 may require less total energy. If the motor and wheel combination cannot provide enough torque to right in a single cycle, rocking can be performed about the Long axis. In an embodiment, rocking might be desired to allow for a smaller auxiliary wheel. In an example, turning to FIG. 9, the model vehicle 100 may comprise an auxiliary motor 160 coupled to a righting wheel 162, wherein the righting wheel 162 may be mounted for rotation about the Long Axis 140 of the model vehicle 100. The righting wheel 162 actuated by the auxiliary motor 160 may be used as described above to generate a rocking motion that may eventually bring the model vehicle 100 upright.

Using the Longer Axis may be the best approach for some model vehicles 100. In alternative embodiments where the model vehicle 100 may be a boat, the boat's propeller and motor are naturally situated to self-right the boat around the Long Axis of the boat. Alternatively, a self-righting motorcycle may have its righting wheel situated to right about the motorcycle's Long Axis.

There may be multiple parameters that may influence the ability of the model vehicle 100 to self-right itself. The optimization of these parameters, while achieving certain vehicle aesthetics, may result in many embodiments. For storing energy, the shape of a body (200 in FIG. 11) of the model vehicle 100 may influence the ease or difficulty of rocking the model vehicle 100. A body 200 with a natural fulcrum (e.g. a mid-cab truck) is easier to rock than a van or SUV styled vehicle (with a long, flat top). A body 200 with a curved top or roof may also be easier to rock. The extent of friction between the body 200 of the model vehicle 100 and the surface the model vehicle 100 is righting from may also play an important role in the self-righting of the model vehicle 100. A smooth body 200, top roof (202 in FIG. 11), or rail between the body 200 of the model vehicle 100 and the surface the model vehicle 100 is righting from may not rock as well since the body 200, top roof 202, or rail may slip when torque is applied. As such, increased friction between the body 200 of the model vehicle 100 and the surface the model vehicle 100 is self-righting from may be crucial. The greater the amount of friction between the body 200 of the inverted model vehicle 100 and the surface the model vehicle 100 is righting from, the more quickly and more easily the model vehicle 100 may self-right.

The stiffness of the 200 body may also affect the ability of the self-righting algorithm to right the model vehicle 100. In an embodiment, the body stiffness may be maximized through additional supports implemented with the construction of the body 200. A body 200 with a maximized stiffness may rock better since the body may be less likely to absorb energy when different pivot points of the body engage the ground when rocking. A body 200 composed of rigid material may be easier to rock and self-right. The body may be formed from a plastic, metal, composite, or other like rigid material which may be suitable for forming the body 200 of a model vehicle 100.

In an embodiment, as shown in FIGS. 11-15, the additional supports may comprise a pair of roll bars 300 implemented with the body 200 of the model vehicle 100. The roll bars 300 may be added to protect the body 200 from abuse when rocking the inverted model vehicle 100 to self-right.

Figure 11:
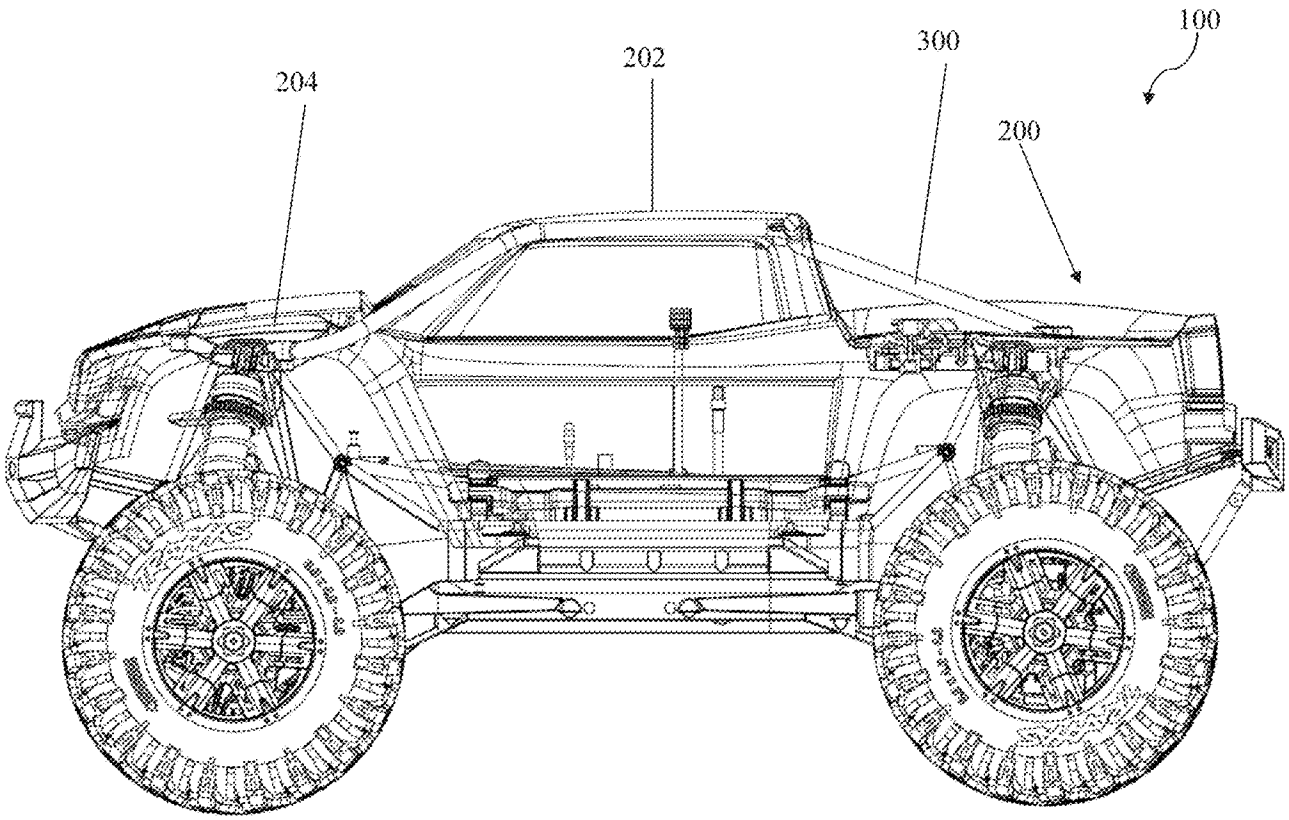
FIG. 11 is a side view of a model vehicle illustrating an embodiment of the model vehicle with a roll bar implemented into the body of the model vehicle.
Figure 12:
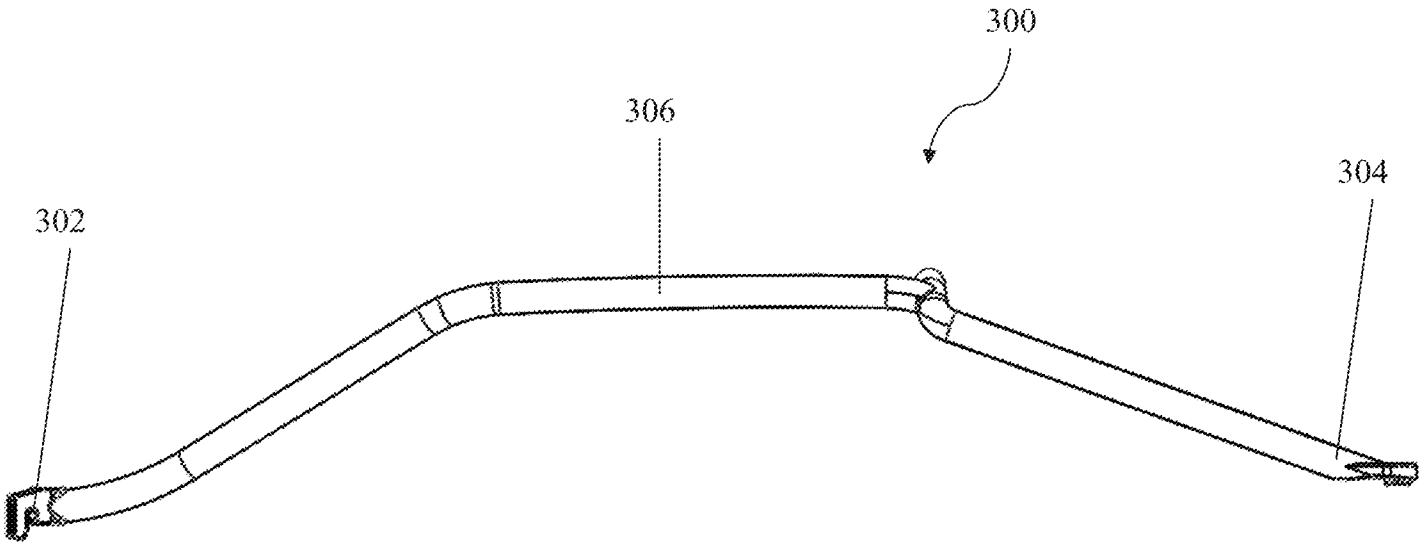
FIG. 12 illustrates a side view of the roll bar.
Figure 13:
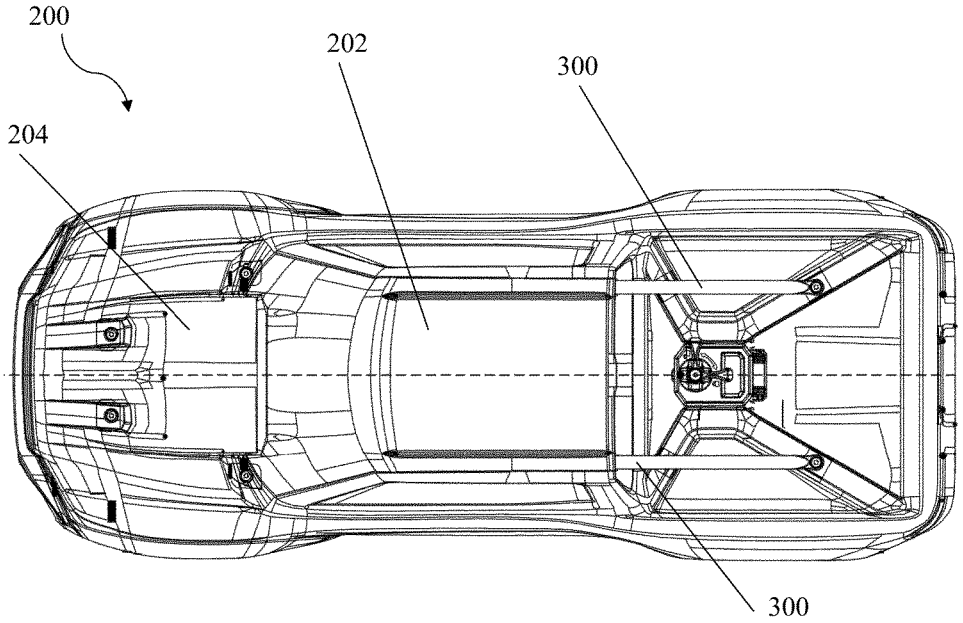
FIGS. 13 and 14 illustrate a top view and side view, respectively, of the body of the model vehicle with the roll bar implemented.
Figure 14:
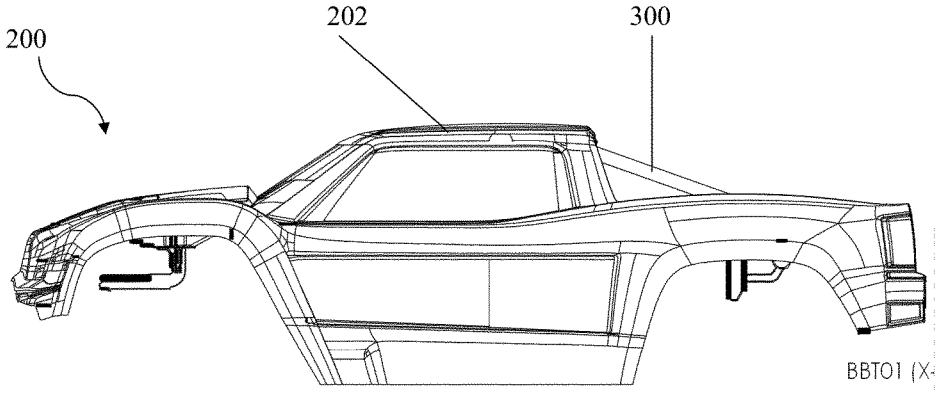
Figure 15:
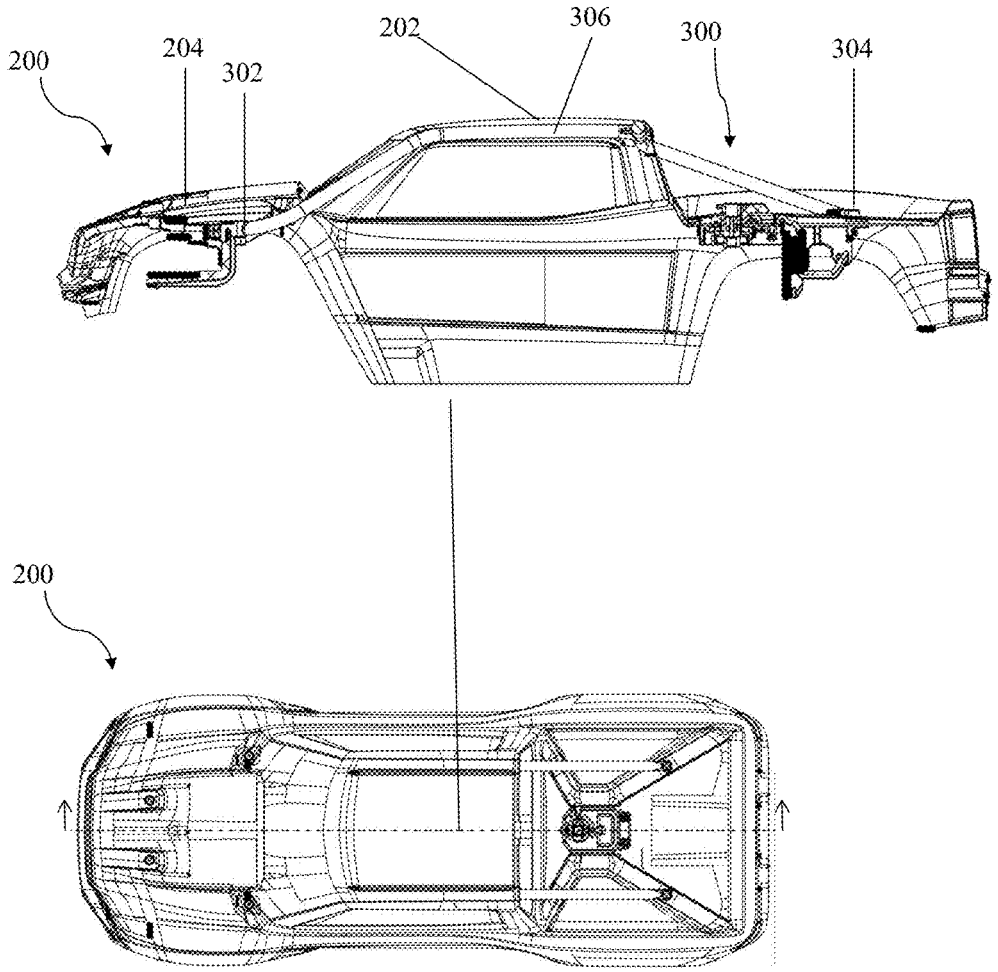
FIG. 15 is a side cross-sectional view of the body of the model vehicle with the roll bar implemented.

Turning to FIGS. 11 and 12, in an embodiment, each of the roll bars 300 comprise a front end 302, a rear end 304, and a mid-section 306. The front end 302 may be connected to and extend from a front portion or a hood 204 of the body 200. The rear end 304 of the roll bar 300 may be connected to the rear portion of the body 200. As shown in FIGS. 11, 13, and 14, the mid-section 306 of each of the roll bars 300 may be aligned along the side or implemented within the roof 202 of the body 200. The model vehicle 100 may be supported by two roll bars 300, with one roll bar 300 extending along each side of the body 200 and with the mid-section 306 of each flanking one of the sides of the roof 202.

When the model vehicle 100 is inverted, the front hood 204, rear portion, and top roof 202 of the body 200 may be impacted against the ground surface the model vehicle 100 is self-righting itself from. To protect the body 200 from substantial damage or abuse, the roll bars 300 may be implemented with the body 200 such that the roll bars 300 extend along and throughout each of the pivot points of the body 200 that may contact the ground when rocking. The roll bars 300 may enable the model vehicle 100 to instead rock along a portion of the roll bar 300 to protect the body 200. However, in an embodiment, a portion of the roll bar 300 may instead be implemented within the body 200. As shown in FIG. 13, a portion of each of the two roll bars 300 may be implemented within the roof 202 and hood 204 of the body 200. When implemented within the body 200, the roll bars 300 may instead provide additional support and strength to the specific portions of the body 200 that may be impacted against the ground when the model vehicle 100 rocks.

The roll bars 300 may be formed such that the cross-sectional shape of the roll bars 300 may be substantially rounded. Alternatively, the cross-sectional shape may be octagonal, hexagonal, trapezoidal, square, triangular, quadrilateral, and the like. The roll bars 300 may also be constructed to be hollow or solid. The roll bars 300 may be formed from a plastic, metal, composite, or any other rigid material which may be suitable for supporting the various pivot points of the model vehicle 100 when rocking. In an embodiment, the additional supports or roll bars 300 may be added or constructed as a cage to be implemented internally, externally, or a combination of internal and external implementation with the body 200 of the model vehicle 100.

In an embodiment, the body 200 may be designed to rock sideways bringing the driven wheel into contact with the ground and allowing the driver to drive upright. Alternatively, the body 200 may comprise a body support which may be used to store energy for deflection by acting as a spring. Likewise, the body support system may intentionally be configured to store this rocking energy.

The timing of the ESC 120 of the model vehicle 100 may be anticipated so that the speed control behavior may be adjusted to compensate for the timing. For example, the ESC 120 may exhibit a delay before applying the brakes to the model vehicle 100. This delay time may be taken into account while determining when to command the ESC 120 to apply acceleration or braking. For example, the command may be sent early to compensate for the delay time or sent later to allow the vehicle to complete or further approach completion of the rocking cycle.

Mechanical or electro-mechanical assistance may be implemented to enhance the rocking of the inverted model vehicle 100. For example, a fulcrum on the top of the model vehicle 100 that deploys when the model vehicle 100 is inverted may aid in self-righting the model vehicle 100.

Furthermore, the inverted starting state (the angle θ) may vary based on terrain or the movement of the C.G. of the model vehicle 100. The CPU and Motor Control firmware may take into account the starting state and may use reverse throttle to initiate rocking in an advantageous direction. Likewise, another embodiment's CPU and Motor Control firmware may take the starting angular rate into account and continue the motion to quickly self-right a model vehicle 100 that would have stopped in the inverted state. This same firmware may also detect free fall so that the automatic self-righting may not activate during a jump.

Furthermore, the model vehicle 100 may not be limited to just using the torque generated with the motor and the wheel to self-right itself. In an alternative embodiment wherein the model vehicle 100 may be a motorcycle, a toppled motorcycle may instead sit at an acute angle (around the long axis) rather than completely inverted. The righting torque to self-right the motorcycle may be generated with a weight connected to a servo's arm. Springs may be added to the side of the motorcycle and energy may be added to the system using the reaction torque from the servo against its weighted arm to initiate rocking of the motorcycle. In this embodiment, the control law in the CPU may be designed to consider the negative torque to bring the angular rate to zero upon righting and continue with subsequent balancing.

Figure 10:
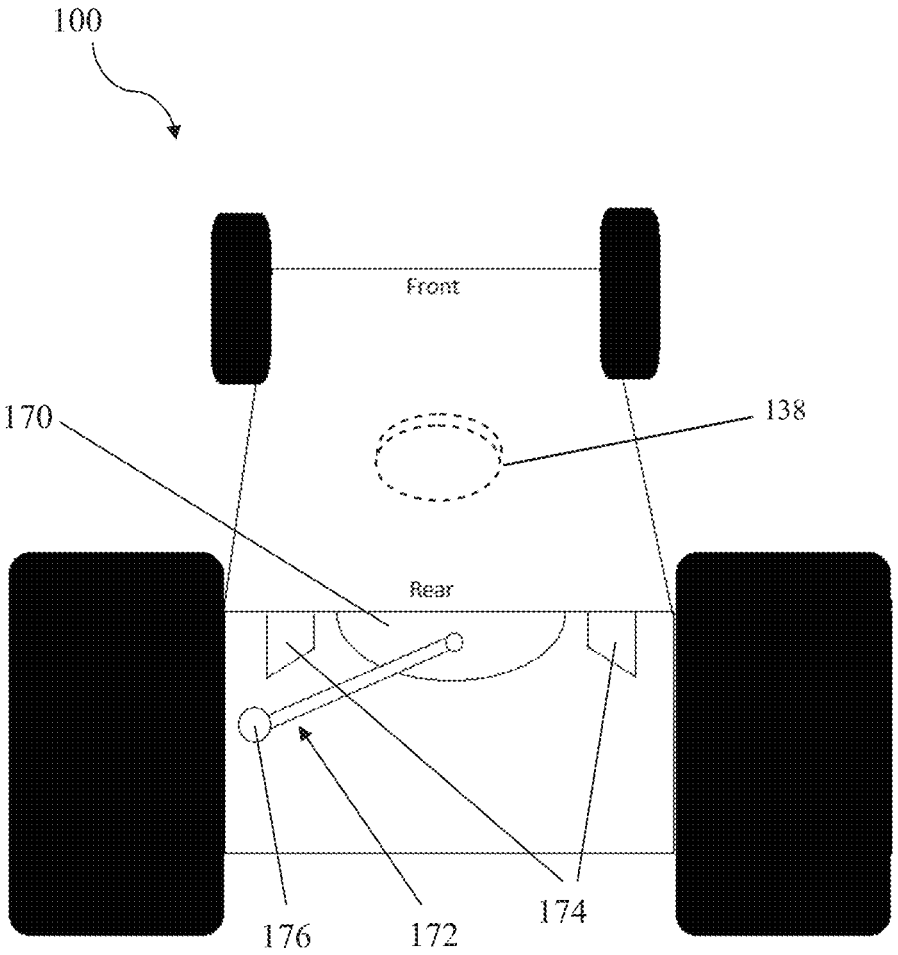
FIG. 10 illustrates an embodiment of the model vehicle with a weighted pendulum for righting the model vehicle about the long axis of the model vehicle.

In an alternative embodiment, as shown in FIG. 10, an inverted model vehicle 100 may comprise a motor or servomechanism (servo) 170 mounted to the chassis of the model vehicle 100. The motor or servo 170 may be connected to a weighted arm 172. As shown in FIG. 10, the weighted arm 172 may further comprise a certain mass 176 at a distal end thereof, and be configured to hang downwards when the model vehicle 100 is inverted. The combination of the weighted arm 172 and the mass 176 hanging from the servo 170 may be constructed to act as a pendulum. A pair of stops 174 may be formed at each end of the maximum swing angle of the weighted arm 172 pendulum. The stops 174 may be any structural feature that limits the maximum swing angle of the weighted arm 172 pendulum. When the model vehicle 100 equipped with the weight arm 172 pendulum is inverted, the control system and method hereinbefore described may be used to operate the motor or servo 170 to swing the weighted arm 172 pendulum. Each of the swings may generate a reaction torque in an opposite direction of the model vehicle 100. A method of timed pushing with pendulum momentum may build a rocking motion that may eventually right the inverted model vehicle 100.

As an alternative to rocking the inverted model vehicle 100 to flip the model vehicle 100 over, the wheels or an internal flywheel 138 instead may be accelerated and then braked abruptly to transfer the rotational energy to the entire model vehicle 100 at once. The rotational energy transferred to the model vehicle 100 may cause the model vehicle 100 to roll into an upright position in one movement.

The present invention has several advantages over other commercial solutions to the "walk of shame" problem. First, the invention may use components provided on the model vehicle 100 for normal operation of the model vehicle 100 to right the model vehicle 100. In normal operation, the wheels, the electronic speed control, the battery, and the electric motor may propel the vehicle. The sensors and the CPU of the receiver 110 may be used for RF communication and vehicle stability. The body of the vehicle may generally be considered aesthetic but does protect the electronics. Because there are no added components for implementing this invention, no weight may be added to the model vehicle 100 and performance of the model vehicle 100 may remain high.

Second, the state estimation and throttle control firmware may be reused from the model vehicle 100 stability control firmware. While this reuse of firmware simplifies development, it also results in smaller sized firmware which fits into smaller or less-expensive memory. Finally, the model vehicle 100 cost remains the same as no new components are needed and no additional electronics may be required.

Example Embodiments

Example Embodiment 1) A method for self-righting a remote control model vehicle, the method comprising:

accepting a user input to initiate a self-righting process (pressing a button on the TX, for example); the self-righting process comprising:

automatically accelerating and decelerating a mass on the vehicle;

using sensors (accelerometers and gyros) to sense the attitude and rate of rotation of the model vehicle;

the attitude and rate of rotation used by the self-righting process to determine effective acceleration and deceleration of the mass;

the attitude and rate of rotation also used to sense when vehicle has been self-righted so it can terminate the self-righting process.

Example Embodiment 2) The method of example embodiment 1 further comprising self-righting about the "long axis".

Example Embodiment 3) The method of example embodiment 1 further comprising self-righting about the "short axis".

Example Embodiment 4) The method of example embodiment 1 further comprising an internally-mounted auxiliary wheel as the mass.

Example Embodiment 5) The method of example embodiment 1 further comprising the vehicle drivetrain, the wheels and tires, for example, as the mass.

Example Embodiment 6) The method of example embodiment 1 further comprising a pop up fulcrum to better facilitate the rocking motion, on a vehicle with a flat roof, for example.

Having thus described the present invention by reference to certain of its exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of exemplary embodiments. Accordingly, it is appropriate that any claims supported by this description be construed broadly and in a manner consistent with the scope of the invention.

The invention claimed is:

1. A method for self-righting an inverted remote controlled model vehicle, the method comprising:

determining a current pitch angle and a current angular rocking rate of the model vehicle;

accelerating or decelerating a mass on the model vehicle based on the current pitch angle and the current angular rocking rate of the model vehicle to create a rocking motion by the model vehicle;

terminating the self-righting process when the model vehicle is upright; and wherein a model vehicle body contacts ground and provides a fulcrum for the rocking motion by the model vehicle.

2. The method in claim 1, wherein accelerating or decelerating the mass may further comprise accelerating or decelerating the mass in a first direction or a second direction, and wherein the first direction is opposite of the second direction.

3. The method in claim 1, wherein the model vehicle further comprises a long axis extending from a front end of the model vehicle to a rear end of the model vehicle, and the self-righting process self-rights the model vehicle about the long axis.

4. The method in claim 1, wherein the model vehicle further comprises a short axis extending from a first side of the model vehicle to a second side of the model vehicle, and the self-righting process self-rights the model vehicle about the short axis.

5. The method in claim 1, further comprising using one or more sensors on the model vehicle to determine the current pitch angle of the model vehicle.

6. The method in claim 1, further comprising using one or more sensors on the model vehicle to determine the current angular rocking rate of the model vehicle.

7. The method in claim 1, further comprising: storing a desired rocking height of the model vehicle; determining a current rocking height of the model vehicle; and accelerating or decelerating a mass on the model vehicle when the current rocking height of the model vehicle is not equal to the desired rocking height of the model vehicle.

8. The method in claim 1, wherein the model vehicle further comprises deploying a movable fulcrum to aid in effectuating the rocking motion by the model vehicle when the mode vehicle is inverted.

9. The method in claim 1, wherein the mass further comprises a weighted arm connected to a servomechanism on the model vehicle.

10. The method in claim 1, wherein the mass further comprises a righting wheel in contact with the ground when the model vehicle is inverted.

11. The method in claim 1, wherein the mass further comprises an internal fly-wheel.

12. The method in claim 1, wherein the mass further comprises a drivetrain of the model vehicle.

13. The method in claim 1, further comprising steering the accelerating or decelerating mass to counter any yaw exhibited by the model vehicle when rocking.

14. The method in claim 1, further comprising steering the accelerating or decelerating mass to impart a yaw on the model vehicle when rocking.

15. A method for self-righting an inverted remote controlled model vehicle, the method comprising:

remotely rocking the model vehicle, rocking comprising:

determining a current pitch angle and a current angular rocking rate of the model vehicle;

accelerating or decelerating a drivetrain on the model vehicle based on the current pitch angle and the current angular rocking rate of the model vehicle to create a rocking motion by the model vehicle;

terminating the self-righting process when the model vehicle is upright; and wherein a model vehicle body contacts ground and provides a fulcrum for the remotely rocking of the model vehicle.

16. The method according to claim 15 wherein one of accelerating or decelerating a mass is powering a model vehicle wheel.

17. The method according to claim 15 wherein one of accelerating or decelerating a mass is braking a model vehicle wheel.

18. A method for self-righting an inverted remote controlled model vehicle, the method comprising:

remotely rocking the model vehicle, rocking comprising:

determining a current pitch angle and a current angular rocking rate of the model vehicle;

accelerating a model vehicle wheel based on the current pitch angle and the current angular rocking rate of the model vehicle;

braking the model vehicle wheel based on the current pitch angle and the current angular rocking rate of the model vehicle;

terminating the self-righting process when the model vehicle is upright; and wherein at a model vehicle body contacts ground and provides a fulcrum for the rocking the model vehicle.

19. The method according to claim 18, wherein the model vehicle body comprises a plurality of fulcrum's for rocking the model vehicle.

20. The method according to claim 18 wherein remotely rocking the model vehicle further comprises:

altering a steering direction of the model vehicle wheel to address desired or undesired yaw of the model vehicle.

* * * * *